US007520502B2

(12) United States Patent
Maeda

(10) Patent No.: US 7,520,502 B2
(45) Date of Patent: Apr. 21, 2009

(54) PAPER TRAY SUPPORTING STRUCTURE

(75) Inventor: Takashi Maeda, Daito (JP)

(73) Assignee: Funai Electric Co., Ltd., Daito-shi, Osaka (JP)

( * ) Notice: Subject to any disclaimer, the term of this patent is extended or adjusted under 35 U.S.C. 154(b) by 256 days.

(21) Appl. No.: 11/185,403

(22) Filed: Jul. 20, 2005

(65) Prior Publication Data

US 2006/0017217 A1 Jan. 26, 2006

(30) Foreign Application Priority Data

Jul. 22, 2004 (JP) ..... 2004-214448

(51) Int. Cl.
*B65H 1/00* (2006.01)

(52) U.S. Cl. ..... 271/162; 271/145

(58) Field of Classification Search ..... 271/145, 271/162

See application file for complete search history.

(56) References Cited

U.S. PATENT DOCUMENTS

| | | | | |
|---|---|---|---|---|
| 3,689,062 | A * | 9/1972 | Minoru | 271/117 |
| 5,975,520 | A * | 11/1999 | Shim | 271/171 |
| 6,145,826 | A * | 11/2000 | Kawata | 270/58.28 |
| 6,595,514 | B2 * | 7/2003 | Takahashi | 271/162 |
| 6,773,182 | B2 * | 8/2004 | Yang | 400/624 |
| 7,306,217 | B2 * | 12/2007 | Bandou et al. | 271/145 |
| 2002/0063374 | A1 * | 5/2002 | Takahashi | 271/10.01 |
| 2005/0127593 | A1 * | 6/2005 | Kinsley et al. | 271/162 |
| 2006/0220295 | A1 * | 10/2006 | Bandou et al. | 271/3.03 |
| 2006/0222436 | A1 * | 10/2006 | Bandou et al. | 400/691 |

FOREIGN PATENT DOCUMENTS

| | | | |
|---|---|---|---|
| JP | 08198480 | A * | 8/1996 |
| JP | 9-295750 | | 11/1997 |
| JP | 2002-193497 | | 7/2002 |

(Continued)

OTHER PUBLICATIONS

Patent Abstracts of Japan, Publication No. 2003-054070, Publication Date: Feb. 26, 2003, 1 page.

(Continued)

*Primary Examiner*—Patrick H Mackey
*Assistant Examiner*—Howard Sanders
(74) *Attorney, Agent, or Firm*—Osha • Liang LLP

(57) ABSTRACT

A paper tray supporting structure includes a rotating shaft connecting each of lateral portions of a paper tray and a paper tray holding portion, a guide groove provided at the paper tray holding portion and formed to have an approximately circular arc shape whose center is at the center of the rotating shaft, a pair of arms projecting from the lateral portions of the paper tray, respectively, approximately in parallel to a direction of a normal to a plane of the paper tray for carrying paper thereof, and a mating protrusion projecting from a tip of each of the arms toward the guide groove and pressing a bottom of the guide groove and sliding thereof as the paper tray turns. At the bottom of the guide groove are provided a first convex portion and a second convex portion to mate with the mating protrusion to place the paper tray in a retracted position and a released position, respectively. When the paper tray is turned between the retracted position and the released position, appropriate frictional force can be applied.

3 Claims, 4 Drawing Sheets

FOREIGN PATENT DOCUMENTS

JP 2003-54070 2/2003

OTHER PUBLICATIONS

Japanese Office Action for patent application No. 214448/2004, mailed Jan. 13, 2009, and English translation thereof, 6 pages.

English Abstract from esp@cenet.com, for patent application with publication No. JP2002193497, Publication Date: Jul. 10, 2002, 1 page.

English Abstract from esp@cenet.com, for patent application with publication No. JP9295750, Publication Date: Nov. 18, 1997, 1 page.

* cited by examiner

PAPER TRAY SUPPORTING STRUCTURE

BACKGROUND OF THE INVENTION

1. Field of the Invention

The present invention relates to a paper tray supporting structure that turnably mounts the paper tray to the body of an image generating apparatus such as a printer or a copying machine.

2. Description of the Background Art

An image generating apparatus such as a printer or a copying machine is provided with a paper tray such as a paper feeding tray for carrying paper to be fed thereon, or a paper receiving tray for receiving ejected paper. The paper tray is often provided to be turnable between a released position in which it projects in a horizontal direction and a retracted position in which it rests along the body of the image generating apparatus.

Japanese Patent Laying-Open No. 2003-054070 describes an example of the turnably-mounted paper tray, which is shown in FIG. 6. A conventional paper tray 81 shown in FIG. 6 has a lateral side provided with a rotating shaft 83, by which paper tray 81 is connected to the apparatus body. Adjacent to rotating shaft 83 and at the rear end of paper tray 81 is provided a stopper 82 having a hemispherical-shaped tip. Stopper 82 is laterally biased by a spring.

A hole into which rotating shaft 83 is inserted is formed in the apparatus body not shown. Furthermore, the apparatus body is provided with concave portions into which the tip of stopper 82 fits to place the paper tray in a released position and a retracted position, respectively.

As described above, the paper tray is provided to be turnable between the released position in which it is placed in an approximately horizontal direction and the retracted position in which it is placed in an approximately vertical direction. While the paper tray turns, frictional force of uniform and appropriate strength preferably acts thereon. If so, resistance caused by the frictional force is transferred to an operator who holds and turns the paper tray, which can give the operator an impression that the paper tray is of high quality. Especially for the case where the paper tray is to be turned from a vertical, retracted position to a horizontal, released position, if frictional force of appropriate strength is not applied to the paper tray, it suddenly turns to the released position due to the self-weight, which makes a collision noise.

For paper tray 81 described in Japanese Patent Laying-Open No. 2003-054070, the tip of stopper 82 biased by the spring slides on an inner surface of the apparatus body. However, almost no frictional force is generated because the tip has a hemispherical shape. Furthermore, the conventional structure requires two extra members, namely, the spring and stopper 82, in addition to the body of the paper tray, which increases the number of parts. Moreover, due to these parts, the number of the assembling steps is disadvantageously increased.

When rotating shaft 83 is spaced farther apart from a point to which frictional force is applied, resistance force can more effectively act on the body of the paper tray. However, in the paper tray supporting structure described in the publication above, stopper 82 is placed adjacent to rotating shaft 83. Therefore, it is necessary to press stopper 82 by means of a significantly strong spring to obtain sufficient frictional force. In such a case, there is a problem of wear in stopper 82 and the apparatus body.

In the structure described in the publication above, assume that rotating shaft 83 is intended to be located farther apart from stopper 82. Since stopper 82 is provided directly at the lateral side of paper tray 81, the rear end of paper tray 81 is required to be extended, which makes paper tray 81 unnecessarily large. Furthermore, it is necessary to ensure a space in the apparatus body into which the rear end of extended paper tray 81 is inserted, which disadvantageously adds a dead space within the apparatus body.

SUMMARY OF THE INVENTION

An object of the present invention is to provide a paper tray supporting structure that can apply appropriate frictional force when the paper tray is turned between a retracted position and a released position, and suppress an increase in number of parts and number of assembling steps of the paper tray.

A paper tray supporting structure according to the present invention having a paper tray provided at an apparatus body to be opened and closed between a retracted position and a released position, and a paper tray holding portion placed adjacent to each of lateral portions of the paper tray for holding the paper tray, includes: a rotating shaft connecting each of the lateral portions of the paper tray and the paper tray holding portion; a guide groove provided at the paper tray holding portion and formed to have an approximately circular arc shape whose center is at the center of the rotating shaft; a pair of arms projecting from the lateral portions of the paper tray, respectively, approximately in parallel to a direction of a normal to a plane of the paper tray for carrying paper thereon; a mating protrusion projecting from a tip of each of the arms toward the guide groove, and pressing a bottom of the guide groove and sliding thereon as the paper tray turns; a first convex portion provided at the bottom of the guide groove and adjacent to a first end thereof, and mating with the mating protrusion to place the paper tray in the retracted position; and a second convex portion provided at the bottom of the guide groove and adjacent to a second end thereof, and mating with the mating protrusion to place the paper tray in the released position. A tip of the mating protrusion is provided with a flat surface to be brought into contact with the bottom of the guide groove.

Preferably, in the paper tray supporting structure, a portion of the mating protrusion between the flat surface at the tip thereof and a lateral surface thereof is configured as a curved surface.

More preferably, in the paper tray supporting structure, a surface of the first convex portion for mating with the tip of the mating protrusion rises at a steeper angle than a corresponding surface of the second convex portion.

In the paper tray supporting structure according to the present invention, when the paper tray is turned between the retracted position and the released position, it is possible to apply appropriate frictional force by sliding the flat surface at the tip of the mating protrusion against the bottom of the guide groove. Furthermore, a movable spring, for example, is not used for the paper tray, which suppresses an increase in number of parts and number of assembling steps of the paper tray. In addition, since the mating protrusion is provided at the tip of each of the arms projecting from each of the lateral sides of the paper tray, the mating protrusion can sufficiently be spaced apart from the rotating shaft without extending the paper tray, resulting in that sufficient frictional force can be applied without using, for example, a spring.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
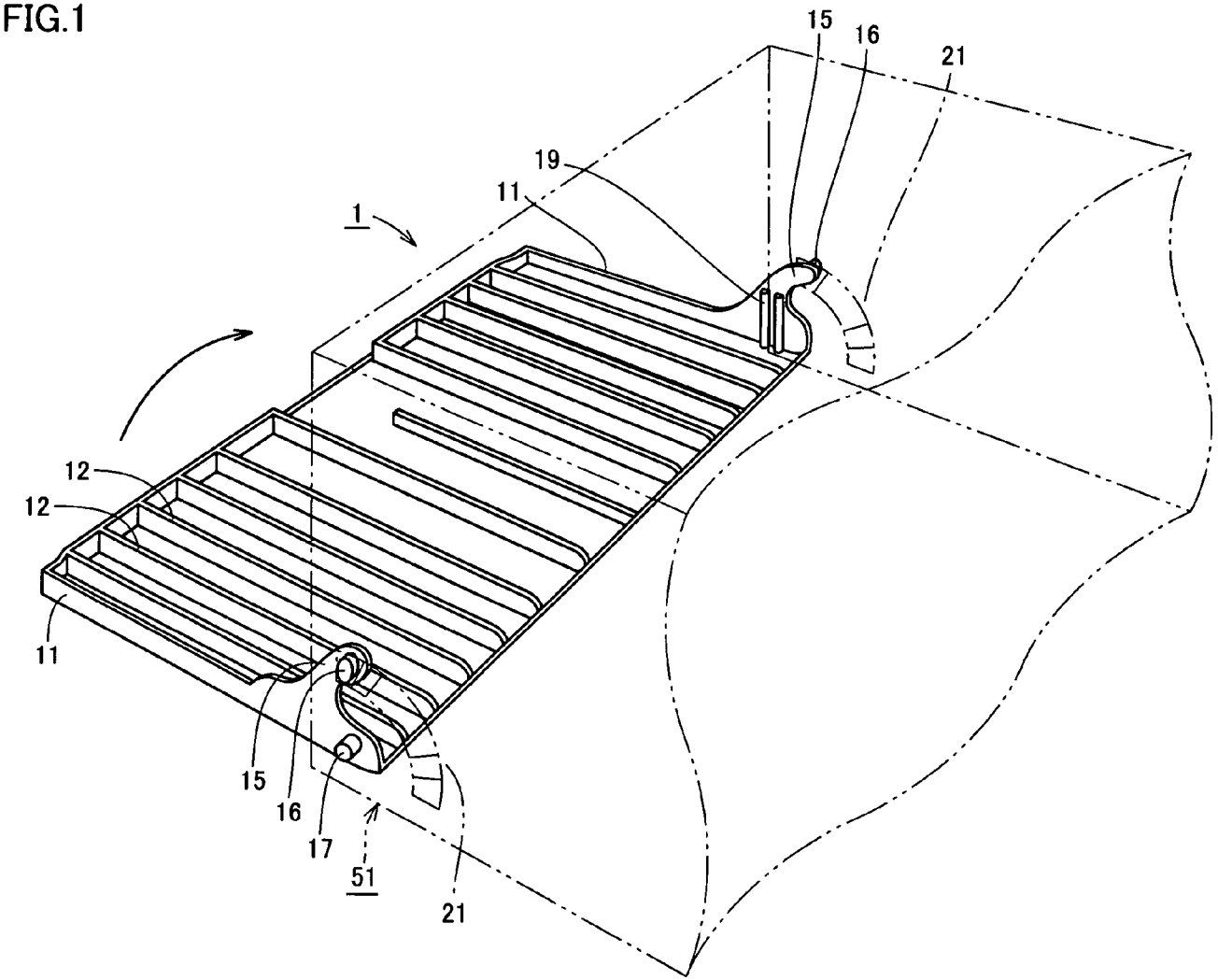
FIG. 1 is a perspective view showing that a paper tray according to an embodiment of the present invention is in a released position.

An embodiment according to the present invention will now be described in reference to FIGS. 1 to 5.

A paper tray holding structure according to the present embodiment is a paper tray supporting structure that has a paper tray 1 provided at an apparatus body to be opened and closed between a retracted position and a released position, and a paper tray holding portion 21 placed adjacent to each of lateral portions 11 of paper tray 1. The paper tray holding structure includes a rotating shaft 17 connecting each of lateral portions 11 of paper tray 1 and paper tray holding portion 21, a guide groove 22 provided at paper tray holding portion 21 and formed to have an approximately circular arc shape whose center is at the center of rotating shaft 17, a pair of arms 15 projecting from the lateral portions of the paper tray 1, respectively, approximately in parallel to a direction of a normal to a plane of paper tray 1 for carrying paper thereon, a mating protrusion 16 projecting from a tip of each of arms 15 toward guide groove 22 and pressing a bottom of guide groove 22 and sliding thereon as paper tray 1 turns, a first convex portion 27 provided at the bottom of guide groove 22 and adjacent to a first end 22*a* thereof and mating with mating protrusion 16 to place paper tray 1 in the retracted position, and a second convex portion 25 provided at the bottom of guide groove 22 and adjacent to a second end 22*b* thereof and mating with mating protrusion 16 to place paper tray 1 in the released position.

As shown in FIG. 1, paper tray 1 is used to serve as a paper feeding tray or a paper receiving tray in an apparatus body 51 of an image generating apparatus such as a printer or a copying machine, and the surface thereof forms a plane for carrying paper thereon. The plane for carrying paper thereon is provided with a plurality of ribs 12, which reduces friction between paper and paper tray 1 so that paper can smoothly be fed and ejected. Paper tray 1 is composed of a single-piece, synthetic resin molding. When paper tray 1 requires longer depth dimension, an extension paper tray is slidably provided thereto.

Arms 15 are provided at the rear ends of lateral portions 11 of paper tray 1, respectively, and project in the direction of the normal to the plane for carrying paper thereon. Each of arms 15 is formed to have a board-like shape such that each of the lateral portions of paper tray 1 is extended in the direction of the normal to the plane for carrying paper thereon. At the tip of each of arms 15 is provided with mating protrusion 16 projecting laterally. Each of arms 15 and mating protrusion 16 are molded integrally with the body of paper tray 1.

In the present embodiment, each of arms 15 is configured such that the width of a base thereof is gradually increased as it approaches each of lateral portions 11. Furthermore, the tip of each of arms 15 is curved toward the rear end of paper tray 1. By doing so, arms 15 have increased strength. In addition, a backside of each of arms 15 is provided with a pair of reinforcement ribs 19, resulting in that arms 15 have much more increased strength. Each of arms 15 is provided to ensure a spacing between the same and rotating shaft 17, and that it may have any shape and is not limited to the above-mentioned shape.

Each of lateral portions 11 of paper tray 1 is provided with rotating shaft 17. Rotating shaft 17 is inserted into a turning hole 29 described below of paper tray supporting portion 21 to turnably journal paper tray 1. In the present embodiment, rotating shaft 17 is provided at each of lateral portions 11 of paper tray 1. Alternatively, however, the turning hole may be provided at each of lateral portions 11 of paper tray 1, and the rotating shaft may be provided at paper tray holding portion 21.

Figure 3:
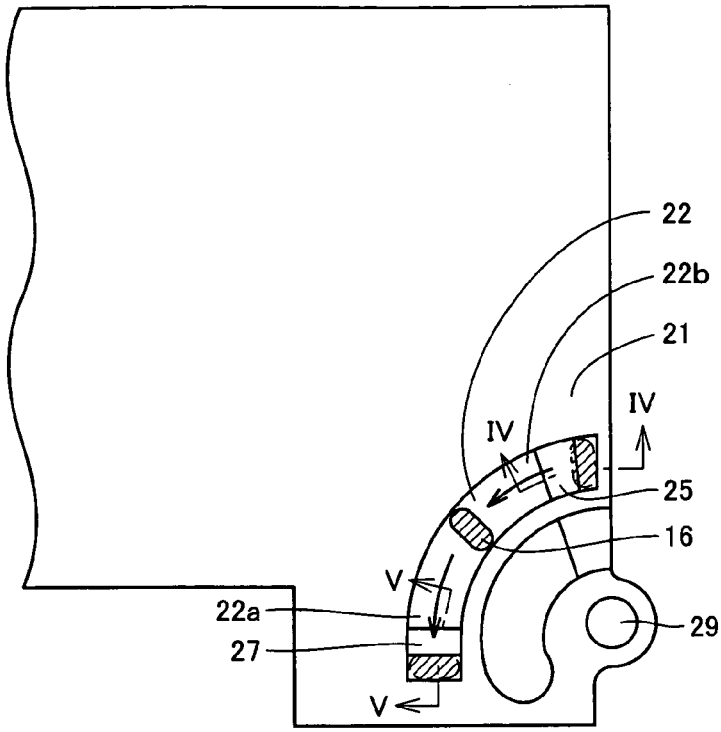
FIG. 3 is a view for describing how a tip portion of a mating protrusion moves in a guide groove of the paper tray holding portion according to the embodiment of the present invention.
Figure 4:
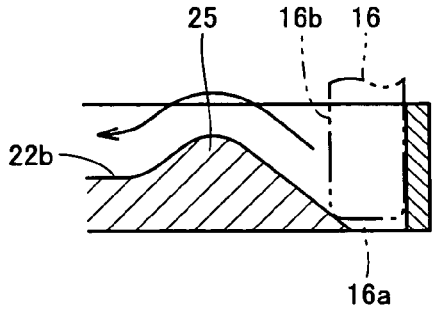
FIG. 4 is a cross section in a direction of an arrow IV-IV in FIG. 3.

As shown in FIG. 3, mating protrusion 16 has an oval cross section, and projects straightforwardly and laterally from an outer surface of each of arms 15. At the tip of mating protrusion 16 is provided with a flat surface 16*a* as shown in FIG. 4. Flat surface 16*a* is brought into contact with the bottom of guide groove 22 and slides thereon. A portion of mating protrusion 16 between flat surface 16*a* thereof and a lateral surface 16*b* thereof is configured as a curved surface. Although the curvature of the curved surface is not particularly limited, it is preferably defined such that flat surface 16*a* has sufficient area and that mating protrusion 16 is smoothly disengaged from first convex portion 27 and second convex portion 25.

Figure 2:
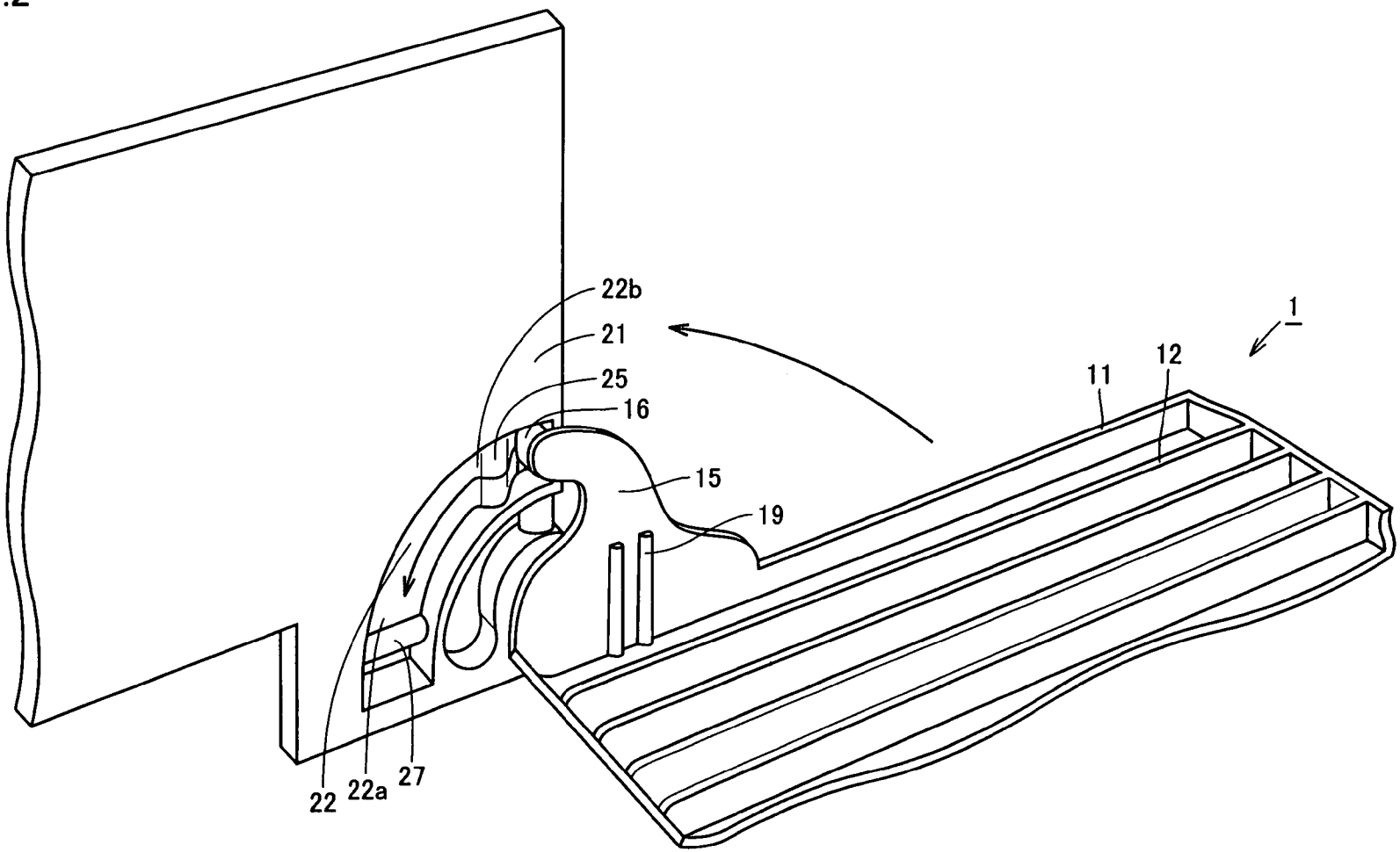
FIG. 2 is a perspective view showing an enlarged portion of the paper tray and a paper tray holding portion according to the embodiment of the present invention.

On each side of paper tray 1 is provided paper tray holding portion 21, which is a member made of resin molding and forming a sidewall of an opening portion of apparatus body 51. As shown in FIG. 3, paper tray holding portion 21 is provided with turning hole 29 into which rotating shaft 17 is inserted. As shown in FIGS. 2 and 3, paper tray holding portion 21 is further provided with guide groove 22 formed to have an approximately circular arc whose center is at the center of rotating shaft 17 of paper tray 1. The bottom of guide groove 22 is formed flat.

Guide groove 22 is provided with first convex portion 27 located at the bottom of guide groove 22 and adjacent to first end 22*a* thereof, and mating with mating protrusion 16 to place paper tray 1 in the retracted position, and second convex portion 25 located at the bottom of guide groove 22 and adjacent to second end 22*b* thereof, and mating with mating protrusion 16 to place paper tray 1 in the released position. Both of first convex portion 27 and second convex portion 25 are formed as ribs located on lines radially extending from the center of turn of paper tray 1. First convex portion 27 and second convex portion 25 are not necessarily formed to have a rib-like shape, and may be formed as, for example, a circular protrusion. However, the rib-like shape can assure that mating protrusion 16 mates with first convex portion 27 and second convex portion 25 more firmly.

Figure 5:
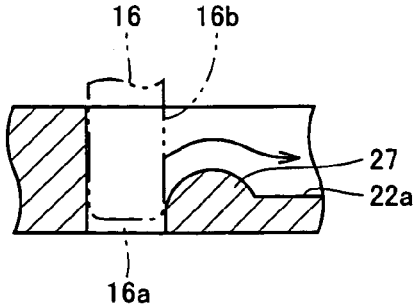
FIG. 5 is a cross section in a direction of an arrow V-V in FIG. 3.
Figure 6:
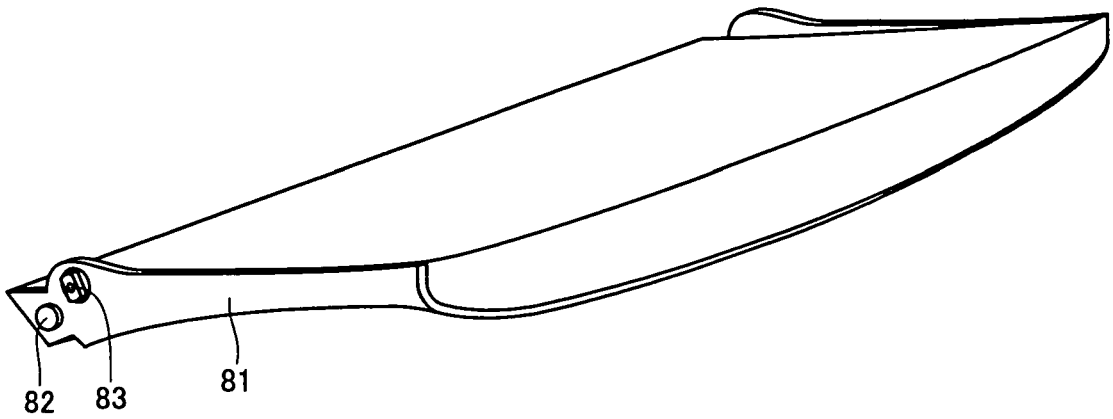
FIG.6 PRIOR ART
FIG. 6 is a perspective view showing a structure of a conventional paper tray.

Although both of first convex portion 27 and second convex portion 25 are formed to have a rib-like shape, shapes of their surfaces are different from each other. Second convex portion 25, which is for holding paper tray 1 horizontally, is formed to have a surface elevated in a relatively smooth manner as shown in FIG. 4. In contrast, first convex portion 27, which is for holding paper tray 1 vertically, is formed to have a surface elevated in a relatively steep manner compared to second convex portion 25. The reason is as follows. When mating protrusion 16 mates with second convex portion 25, paper tray 1 is held horizontally and rendered stable due to its own weight. In contrast, when mating protrusion 16 mates with first convex portion 27, paper tray 1 is held vertically and rendered unstable, which requires firmer engagement therebetween. Therefore, in addition thereto, the bottom of the groove is opened on the outside (left side in FIG. 5) of first convex portion 27, as shown in FIG. 5, to allow the tip of mating protrusion 16 fit thereinto, which enables paper tray 1 to be held more stably in the retracted position.

Since both of first convex portion 27 and second convex portion 25 have sufficient height, sufficient resistance can be provided to mating protrusion 16 in the case where paper tray 1 is turned to mate with first convex portion 27 and second convex portion 25. Therefore, an appropriate clicking feeling (operational feeling) can be provided to an operator who turns paper tray 1. The clicking feeling enables the operator to make sure that paper tray 1 is held in a given position (the retracted position or the released position). Furthermore, since the tip of mating protrusion 16 has a corner composed of a curved surface, mating protrusion 16 can smoothly slide against first convex portion 27 and second convex portion 25, and it is possible to ensure that first convex portion 27, second convex portion 25, and mating protrusion 16 have little wear.

As the operator turns paper tray 1 to disengage mating protrusion 16 from first convex portion 27 and second convex portion 25 and further turns the paper tray 1, flat surface 16*a* at the tip of mating protrusion 16 slides against the bottom of guide groove 22. Mating protrusion 16 is configured such that it is continuously pressed against the bottom of guide groove 22 due to a spring property of each of arms 15 in a direction from its top side to reverse side (a direction of the width of paper tray 1), which causes appropriate frictional force between flat surface 16*a* at the tip of mating protrusion 16 and the bottom of guide groove 22 formed to be flat.

The frictional force above is transferred to the body of paper tray 1 through arms 15. Since mating protrusion 16 provided at the tip of each of arms 15 is sufficiently spaced apart from rotating shaft 17, the frictional force is fully transferred to the operator who holds the tip of paper tray 1 for operation, which can give the operator an impression that the apparatus is of high quality. Even if the operator releases the hand from paper tray 1 while turning the same from the retracted position to the released position, for example, paper tray 1 can gently move to the released position because appropriate frictional force is applied. As a result, a collision noise, for example, can be prevented.

In the present embodiment, mating protrusion 16 slides in guide groove 22. Therefore, even if large force is applied to paper tray 1, a lateral surface of mating protrusion 16 strongly abuts an inner, lateral surface of guide groove 22, which can reduce load applied to rotating shaft 17 of paper tray 1. If much larger frictional force is required, the lateral surface of mating protrusion 16 may be slid against the inner, lateral surface of guide groove 22.

Paper tray 1 according to the present embodiment is molded integrally with each of arms 15 and mating protrusion 16. Therefore, an increase in number of parts and number of assembling steps is suppressed.

Furthermore, each of arms 15 according to the present embodiment projects from each of lateral portions 11 of paper tray 1 approximately in parallel to the direction of the normal to the plane for carrying paper thereon. When paper tray 1 is placed in the retracted position, arms 15 are inserted into apparatus body 51, which only requires a space therefor exclusively adjacent to the sidewall of the opening portion of apparatus body 51 (paper holding portion 21). Consequently, a space between one and the other of arms 15 can effectively be utilized, which minimizes the dead space of apparatus body 51.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A paper tray supporting structure including a paper tray provided at an apparatus body to be opened and closed between a retracted position and a released position, and a paper tray holding portion placed adjacent to each of lateral portions of said paper tray for holding said paper tray, comprising:

a rotating shaft connecting each of the lateral portions of said paper tray and said paper tray holding portion, wherein an end portion of each of the lateral portions proximate the apparatus body when in the released position is integrally formed an arm projecting in a plane approximately normal to a plane of said paper tray;

a guide groove provided at said paper tray holding portion and formed to have an approximately circular arc shape whose center is at the center of said rotating shaft;

a mating protrusion projecting from a tip of each of said arms toward said guide groove, and pressing a bottom of said guide groove and sliding thereon as said paper tray turns;

a first convex portion provided at the bottom of said guide groove and adjacent to a first end thereof, and mating with said mating protrusion to place said paper tray in the retracted position; and a second convex portion provided at the bottom of said guide groove and adjacent to a second end thereof, and mating with said mating protrusion to place said paper tray in the released position, wherein a tip of said mating protrusion is provided with a flat surface to be brought into contact with the bottom of said guide groove and a portion of said mating protrusion between said flat surface thereof and a lateral surface thereof is configured as a curved surface, and wherein a surface of said first convex portion for mating with the tip of said mating protrusion rises at a steeper angle relative to the flat surface of the tip of said mating protrusion in the retracted position than a corresponding plane of said second convex portion relative to the flat surface of the tip of said mating protrusion in the released position, and wherein the rotating shaft is provided on the end portion of the lateral portion formed as the arm.

2. A paper tray supporting structure including a paper tray provided at an apparatus body to be opened and closed between a retracted position and a released position, and a paper tray holding portion placed adjacent to each of lateral portions of said paper tray for holding said paper tray, comprising:

a rotating shaft connecting each of the lateral portions of said paper tray and said paper tray holding portion, wherein an end portion of each of the lateral portions proximate the apparatus body when in the released position is integrally formed as an arm projecting in a plane approximately normal to a plane of said paper tray;

a guide groove provided at said paper tray holding portion and formed to have an approximately circular arc shape whose center is at the center of said rotating shaft;

a mating protrusion projecting from a tip of each of said arms toward said guide groove, and pressing a bottom of said guide groove and sliding thereon as said paper tray turns;

a first convex portion provided at the bottom of said guide groove and adjacent to a first end thereof, and mating with said mating protrusion to place said paper tray in the retracted position; and a second convex portion provided at the bottom of said guide groove and adjacent to a second end thereof, and mating with said mating protrusion to place said paper tray in the released position, wherein a tip of said mating protrusion is provided with a flat surface to be brought into contact with the bottom of said guide groove, and wherein a portion of said mating protrusion between the flat surface at the tip thereof and a lateral surface thereof is configured as a curved surface, and wherein the rotating shaft is provided on the end portion of the lateral portion formed as the arm.

3. A paper tray supporting structure including a paper tray provided at an apparatus body to be opened and closed between a retracted position and a released position, and a paper tray holding portion placed adjacent to each of lateral portions of said paper tray for holding said paper tray, comprising:

a rotating shaft connecting each of the lateral portions of said paper tray and said paper tray holding portion, wherein an end portion of each of the lateral portions proximate the apparatus body when in the released position is integrally formed as an arm projecting in a plane approximately normal to a plane of said paper tray;

a guide groove provided at said paper tray holding portion and formed to have an approximately circular arc shape whose center is at the center of said rotating shaft;

a mating protrusion projecting from a tip of each of said arms toward said guide groove, and pressing a bottom of said guide groove and sliding thereon as said paper tray turns;

a first convex portion provided at the bottom of said guide groove and adjacent to a first end thereof and mating with said mating protrusion to place said paper tray in the retracted position; and a second convex portion provided at the bottom of said guide groove and adjacent to a second end thereof, and mating with said mating protrusion to place said paper tray in the released position, wherein a tip of said mating protrusion is provided wit a flat surface to be brought into contact with the bottom of said guide groove, and wherein a surface of said first convex portion for mating with the tip of said mating protrusion rises at a steeper angle relative to the flat surface of the tip of said mating protrusion in the retracted position than a corresponding plane of said second convex portion relative to the flat surface of the tip of said mating protrusion in the released position, and wherein the rotating shaft is provided on the end portion of the lateral portion formed as the arm.

* * * * *

UNITED STATES PATENT AND TRADEMARK OFFICE

CERTIFICATE OF CORRECTION

PATENT NO. : 7,520,502 B2
APPLICATION NO. : 11/185403
DATED : April 21, 2009
INVENTOR(S) : Takashi Maeda It is certified that error appears in the above-identified patent and that said Letters Patent is hereby corrected as shown below:

On the Title Page:

On the Title Page, section (57) Abstract, line 8, the word "thereof" should be

--thereon--.

On the Title Page, section (57) Abstract, line 11, the word "thereof" should be

--thereon--.

In the Claims:

In Claim 1, column 6, line 21, "formed an" should read --formed as an--.

In Claim 3, column 8, line 18, "wit" should read --with--.

Signed and Sealed this

Twenty-eighth Day of July, 2009

John Doll

JOHN DOLL
*Acting Director of the United States Patent and Trademark Office*